US010074265B2

(12) United States Patent
Moffa

(10) Patent No.: US 10,074,265 B2
(45) Date of Patent: Sep. 11, 2018

(54) MESH NETWORK TESTING SYSTEM AND METHOD FOR FIRE ALARM SYSTEM

(71) Applicant: Tyco Fire & Security GmbH, Neuhausen am Rheinfall (CH)

(72) Inventor: Anthony Philip Moffa, Northborough, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 15/088,533

(22) Filed: Apr. 1, 2016

(65) Prior Publication Data

US 2017/0287319 A1 Oct. 5, 2017

(51) Int. Cl.
*G08B 29/00* (2006.01)
*G08B 29/14* (2006.01)

(52) U.S. Cl.
CPC ..... *G08B 29/145* (2013.01)

(58) Field of Classification Search
CPC ..... G08B 25/009; G08B 25/14; G08B 29/22; G08B 29/123; G08B 29/145; G08B 29/14; G08B 29/12; G08B 17/00; G08B 29/043; G08B 25/10; G08B 29/046; G08B 29/126; G08B 29/185; G08B 29/00; G08B 29/02
USPC ..... 340/506, 514, 539.18, 539.1, 539.2, 525
See application file for complete search history.

(56) References Cited

U.S. PATENT DOCUMENTS 7,113,090 B1 * 9/2006 Saylor ..... G08B 13/19682 340/5.33
2007/0139183 A1 * 6/2007 Kates ..... G08B 25/005 340/521
2007/0241878 A1 * 10/2007 Jobe ..... G08B 25/009 340/506
2008/0084291 A1 * 4/2008 Campion ..... G08B 29/145 340/514
2013/0154823 A1 * 6/2013 Ostrer ..... G08B 21/18 340/539.1
2015/0163758 A1 * 6/2015 Frison ..... H04W 56/004 370/350
2015/0206421 A1 7/2015 Moffa

* cited by examiner

*Primary Examiner* — Anh V La
(74) *Attorney, Agent, or Firm* — HoustonHogle LLP

(57) ABSTRACT

A system and method for testing fire detection and fire annunciation/notification devices of a fire alarm system includes a central operations system, which provides a link between a control panel of the fire alarm system and a mobile computing device operated by a technician. One or more wireless nodes create a mesh network between the control panel and a testing computer. Then, during a walk-through test, the on-site technician activates fire detection or fire annunciation devices of the fire alarm system and the activated devices signal the control panel and event data are generated. Event data from the control panel are sent to the central operations system via the mesh network. The central operations system sends the event data to a mobile computing device operated by the technician. The on-site technician is then able verify that the devices are physically sound, unaltered, working properly, and located in their assigned locations.

19 Claims, 7 Drawing Sheets

MESH NETWORK TESTING SYSTEM AND METHOD FOR FIRE ALARM SYSTEM

BACKGROUND OF THE INVENTION

Fire alarm systems are often installed within buildings such as commercial, residential, or governmental buildings. Examples include hospitals, warehouses, schools, malls and casinos, to list a few examples. These fire alarm systems typically include a control panel and fire detection devices and fire annunciation devices, which are installed throughout the buildings. Some examples of fire detection devices include smoke detectors, carbon monoxide detectors, temperature sensors, and/or pull stations. Some examples of fire annunciation devices include speakers/horns, bells/chimes, light emitting diode (LED) reader boards, and/or flashing lights (e.g., strobes).

The fire detection devices monitor the buildings for indicators of fire. Upon detection of an indicator of fire, the device is activated and a signal is sent from the activated device to the fire control panel. Typically, the fire control panel activates audio and visible components of the fire annunciation/notification devices connected to the fire alarm system and additionally sends a signal to a fire department, central receiving station, local monitoring station, and/or other building alarm/notification systems.

Typically, the fire detection and fire annunciation devices are periodically tested (e.g., monthly, quarterly, or annually depending on local interpretation and enforcement of fire protection codes) to verify that the fire detection and fire annunciation devices are physically sound, unaltered, working properly, and located in their assigned locations. This testing of the fire detection and fire annunciation devices is often accomplished with a walkthrough test.

Historically, walkthrough tests were performed by a team of at least two technicians. The first technician walked through the building and manually activated each fire detection and fire annunciation device while the second technician remained at the control panel to verify that the control panel received a signal from the activated device. The technicians would typically communicate via two-way radios or mobile phones to coordinate the testing of each device. In some cases, the technicians might even have resorted to comparing hand written notes of the tested devices. After a group of fire detection and fire annunciation devices was tested, the technician at the panel reset the control panel while the other technician moved to the next fire detection or fire annunciation device.

Recently, single-person walkthrough systems have been proposed. In these systems, the technician connects a facilities testing computer to the control panel and a first two-way radio. The technician then establishes a communications link with the first two-way radio using a second two-way radio and selecting the same radio frequency on both of the two-way radios. Alternatively, the technician may establish a communications link with cellular phones or a paging transmitter and pager.

During the walkthrough test, the technician places one of the fire detection or fire annunciation devices into an alarm condition. The control panel detects the alarm condition of the activated device and sends a message containing the location and/or address of the activated device to the facilities testing computer. Next, the computer converts the message received from the control panel to an audio stream and sends the audio stream to the technician over the communications link. The technician hears the location and/or address of the activated device and verifies if the device is wired correctly. The testing process repeats with the next fire detection or fire annunciation device until all of the fire detection and fire annunciation devices of the alarm system have been verified.

More recently, networked testing systems that utilize a cloud based infrastructure (e.g., central communications system) have been developed. See U.S. Pat. Appl. Publ. No. US 2015/0206421 A1 by Anthony P. Moffa, which is incorporated herein by this reference. Here, the central communications system connects the control panel of a fire alarm system and a mobile computing device operated by an on-site technician. The central communications system receives event data from the control panel via the facilities testing computer and sends the event data to the mobile computing device in real-time. Illustrated by way of example, upon activation of a fire detection or fire annunciation device, the control panel receives a signal from the activated device. Event data are generated and sent to the central communications system. The event data are stored and/or logged by the central operations system and also sent to the mobile computing device in real-time. The on-site technician is able to view the event data and verify that the fire detection or fire annunciation device is physically sound, unaltered, working properly, and in its assigned location. The technician then moves to test the next fire detection or fire annunciation device. This mobile link also incorporates the ability to send operational commands from the mobile device to the fire alarm control panel. As such, operations like silencing the audio and visual devices or resetting the control panel fire alarm count can be triggered from the mobile device thus limiting required travel to the panel to just setup and removal of the facility testing computer.

SUMMARY OF THE INVENTION

In practice, a number of issues have arisen with these cloud-based, networked testing systems.

First, these systems rely on the availability of cellular communications. The facilities testing computer includes a cellular data modem that is used to uplink the event data that it receives from the control panel to the central communications system. Then, the central communications system logs and downlinks the event data to the technician's mobile computing device.

It can be difficult to establish a cellular datalink using the cellular data modem when it is connected to the control panel. It is not uncommon for the control panels to be located in interior and/or hardened and/or fire rated areas of buildings such as a room, closet or basement. As a result, it is not always possible to establish the cellular uplink.

Attempts have been made to provide stronger cellular signals for the facilities testing computers. They can be moved closer to a strong cellular signal by extending the serial cable or USB cable connecting the cellular modem, but there are practical limits to this solution. Cellular repeaters are another option, though they are expensive (if installed permanently) and are generally a safety hazard if used temporarily.

It is also not uncommon for the facilities testing computers to be lost. They can be forgotten, and left connected to the control panel by the technicians after completion of the testing of the fire alarm systems. This can be unfortunate since they are often expensive specially designed systems. Moreover, simply the act of transporting the facilities testing computer from the technician's truck to the room in which the control panel is located can result in the computer being dropped or mishandled.

The intent of the invention is to avoid the necessity of transporting the facilities testing computer inside the building, not just the room in which the control panel is installed, This allows for better access to cellular connections.

Moreover, by using lower frequency and bandwidth radio technologies, the control panel to facilities testing computer serial communication link can be separated wirelessly by a few feet up to a few hundred feet. If longer distances are required than a single pair of transceivers can achieve, multiple devices can be used to create a series of links or a mesh.

The testing computer can now be located outside the realm of the building, not just the room that the panel is installed in. This allows for better access to cellular connections. In one example, when a technician arrives, the testing computer will detect and connect to the mesh network, In this instance, the technician never has to take the testing computer into the building. It is secure, cannot be stolen or damaged and it can run off the vehicle battery. In addition, the cellular modem could be connected to a high gain cellular antenna and GPS receiver mounted to the exterior of the truck. The cellular antenna further improves reception and the GPS antenna provides details on the physical location of the vehicle.

In general, according to one aspect, the invention features a method for testing a fire alarm system. This method comprises establishing a wireless connection between a control panel of the fire alarm system and a testing computer and a technician activating devices of the fire alarm system, event data being sent from the control panel to the testing computer over the wireless connection.

In embodiments, the event data from the testing computer is then sent to a central operations system and from the central operations system to a mobile computing device operated by the technician.

The wireless connection is established by connecting a primary mesh node to the control panel. One or more secondary mesh nodes can then be deployed in the building of the control panel. These nodes can also be deployed in connection with devices of the fire alarm system.

In general, according to another aspect, the invention features a testing system for testing a fire alarm system. This system comprises a testing computer and one or more wireless nodes that establish a wireless connection between a control panel of the fire alarm system and the testing computer. The generated event data can then be sent from the control panel to the testing computer over the wireless nodes.

In general, according to another aspect, the invention features a wireless node for a testing system for a fire alarm system. The node comprises a wireless transceiver for establishing one or more wireless links to a testing computer and a wired adapter port for connection to a control panel.

Usually, the wireless transceiver transmits event data from the control panel to the testing computer over the wireless links.

A battery and/or a power port is usually provided for powering the node. The node can also receive power from a fire alarm device.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
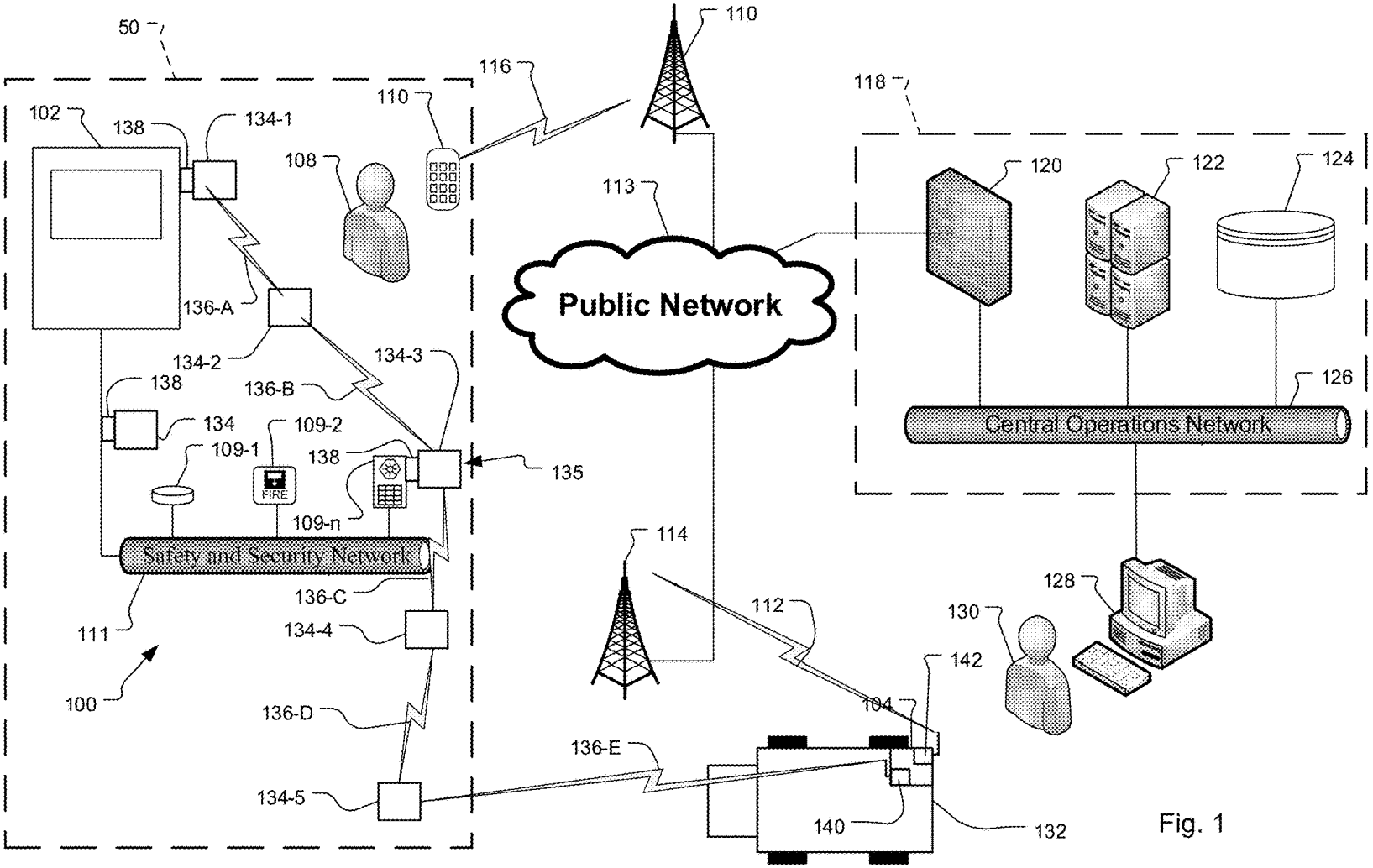
FIG. 1 is a block diagram illustrating the use of the mesh network testing system in relationship between a fire alarm system, a central operations system, and a technician's mobile computing device.

FIG. 1 is block diagram illustrating the relationship between a fire alarm system 100, a facilities testing computer 104, a central operations system 118, and a mobile computing device 110 operated by the on-site technician 108. It shows the use of a mesh wireless network to connect the fire alarm system's control panel 102 with the facilities testing computer 104, which is installed, possibly permanently, in the technician's truck 132, for example.

In a typical implementation, the fire alarm system 100 is located within a building 50. The building could be residential, commercial or governmental. Examples include a hospital, warehouse, retail establishment, mall, school, or casino, to list a few examples.

In the illustrated example, the fire alarm system 100 includes the fire control panel (control panel) 102 and fire detection and fire annunciation/notification devices 109-1 to 109-n. The fire detection devices typically include smoke detectors, carbon monoxide detectors, temperature sensors, and/or pull stations, to list a few examples. Similarly, examples of the fire annunciation/notification devices generally include speakers/horns, bells/chimes, light emitting diode (LED) reader boards and/or flashing lights (e.g., strobes). The fire detection and fire annunciation/notification devices 109-1 to 109-n and control panel 102 are connected to a safety and security wired and/or wireless network 111 of the building 50, which supports data and/or analog communication between the devices 109-1 to 109-n and the control panel 102.

While not shown in the illustrated example, the fire alarm system and the safety and security network are often divided into different zones. For example, each floor in an office building may be a separate zone of the system, These separate zones may be controlled with separate control panels and/or subpanels.

Returning to the illustrated example, a facilities testing computer (testing computer) 104 is wirelessly connected to the control panel 102 via a wireless mesh 135 of nodes 134.

In the illustrated example, a primary mesh node 134-1 is connected to the control panel 102 with an RS-232 cable, for example. Alternative embodiments, however, may utilize other cables such as a universal serial bus (USB) cable or Ethernet (IEEE 802.3) cable (e.g., Cat 5 or Cat 6), to list a few examples, to provide the connection between the control panel 102 and primary mesh node 134-1.

Additionally, the primary mesh node can be deployed in a number of different ways. In one example, the primary mesh node 134-1 is installed permanently and potentially even integrated with the control panel 102. In another example, however, the primary mesh node 134-1 is temporarily connected to the control panel 102 by the technician 108 during the fire alarm testing process. Then, once this testing process is completed, the primary mesh node 134-1 is disconnected from the control panel 102 and removed by the technician for use at the next test in another building.

A series of secondary mesh nodes 134-2 to 134-5 are then used to establish a wireless mesh network connection 135 between the control panel 102 and the facilities testing computer 104.

As illustrated, these secondary mesh nodes 134-2 to 134-5 can be deployed in a number of different ways, For example, secondary mesh node 134-2 might be located near the control panel 102. It could be located in an adjacent room or hallway.

In contrast, secondary mesh node 134-3 is installed in connection with a strobe device 109-n. Here, the secondary mesh node 134-3 could be permanently connected to the strobe device 109-n such as connected to a specially-designed port on the strobe device. In one example, this secondary mesh node 134-3 parasitically harvests power from the strobe device.

In other examples, mesh nodes could be put in smoke detectors. Some smoke detectors have a sounder base that accepts modules such as a CO cartridge. The transceiver can be another module that can be inserted into the sounder base instead of the CO detector, Generally, there is always a smoke detector over the fire alarm control panel as part of the code. Installing a transceiver into this detector improves the otherwise muted signal coming from the metal enclosed fire panel.

Finally, secondary mesh nodes 134-4 and 134-5 further fill-out the mesh wireless network 135 to establish the wireless connection between the control panel 102 and the facilities testing computer 104, and specifically its mesh transceiver 140.

In the illustrated embodiment, the mesh network 135 comprises the wireless link 136-A between the primary mesh node 134-1 and the secondary mesh node 134-2, the wireless link 136-B between the secondary mesh nodes 134-2 and 134-3, the wireless link 136-C between the secondary mesh nodes 134-3 and 134-4, and the wireless link 136-D between the secondary mesh nodes 134-4 and 134-5. The final wireless link 136-E extends between the final secondary mesh node 134-5 and the mesh transceiver 140 that is integrated into the facilities testing computer 104.

The wireless links 136 that connect the mesh network 135 could use one or more of a number of different wireless communication technologies and protocols. In one implementation Wi-Fi (IEEE 802.11) is used. But in other implementations, wireless connections such as sub-GHz serial, Bluetooth, ZigBee, PowerG, or LoRa® technology wireless system is used, to list a few examples. Sub-gigahertz frequencies offer lower bandwidth than Wi-Fi protocols, but they tend to travel better in commercial applications as they are less likely to be absorbed by the building infrastructure. As such they provide the ability to extend the distance between nodes thus reducing the cost and complexity of the infrastructure.

The testing computer 104 connects to a public network 113 (e.g., the Internet) over possibly a wireless cellular communication link 112 using a cellular modern 142. In a current implementation, the wireless communication link 112 is encrypted using standard SSL (Secure Sockets Layer) encryption methods with the option for additional encryption such as Advanced Encryption Standard (AES), in specific implementations. The data are routed through one or more cellular radio towers (e.g., reference numeral 110) of a mobile broadband or cellular network. Typically, the radio tower uses GPRS (General Packet Radio Service), GSM (Global System for Mobile Communications), or a CDMA (Code Division Multiple Access) technology. In an alternative embodiment, the testing computer 104 may connect to the public network 113 via public and/or private wired data networks such as an enterprise network or Wi-Max or Wi-Fi network, for example. The testing computer 104, and the mobile technician's phone or tablet do not need to be on the same network.

The mobile computing device 110 is connected to the public network 113 over a wireless communication link 116 and operated by the on-site technician 108. Similar to the testing computer 104, the data on the public network 113 and en-route to the mobile computing device 110 via the wireless communications link 116, is preferably encrypted using SSL encryption. In a current embodiment, the mobile computing device 110 is a laptop computer, smart phone, tablet computer, or phablet computer (i.e., a mobile device that is typically larger than a smart phone, but smaller than a tablet), to list a few examples. In an alternative embodiment, the mobile computing device 110 may also connect to the public network 113 via public and/or private data networks.

While the illustrated example only shows a single on-site technician 108, it is possible for two or more on-site technicians, each equipped with their own mobile computing device, to perform testing in parallel. While this does not reduce the manpower or costs needed to complete the walkthrough test, it can reduce the amount of time needed to complete the test, which may be desirable in buildings where disruptions are undesirable (e.g., hospitals).

The central operations system 118 preferably includes a central operation system firewall 120, an applications server 122, and a data storage system 124.

The central operation system firewall 120 is a software or hardware network security feature which filters incoming and outgoing network traffic to increase security for the central operations network 126. The applications server 122 acts as the repository and portal to access event data generated by the control panel 102 and sent by the facilities testing computer 104. While the fire detection or fire annunciation devices are manually activated by the on-site technician during the walkthrough test, all event data are generated by the control panel 102. This ensures that test data cannot be manually entered, altered, or falsified.

Typically, the event data include the unique identifier for the fire alarm control panel 102, a physical address of the activated devices (109-1, 109-2 . . . 109-n), a date and time of the activation, a fault state of the activated devices, at least one analog and/or detected value by the activated devices such as a detected smoke level or detected ambient temperature, and/or custom labels of the activated devices. Additionally, acknowledgement and restoral times of the control panel events are included in the event data.

In a current implementation, the analog and/or detected value is included as part of the event data on the mobile computing device to indicate that a device needs to be serviced or cleaned. This enables devices that require occasional cleaning to be identified during the walkthrough test.

The central operation system firewall 120, applications server 122, and data storage system 124 are connected via a central operations network 126. The central operation network 126 is a data network such as an enterprise network, for example.

The illustrated embodiment further includes a remote technician 130. This technician 130 is able to access the central operations system 118 with a remote workstation 128. This remote technician 130 may support and/or monitor the progress of the on-site technician 108. In an alternative embodiment, this remote workstation 128 is securely connected to the central operations network 126 using the public network 113. Connectivity to the public network 113 is achieved in a variety of ways including, for example, cellular data networks, private and/or public hardwired or wireless networks as well as other options known in the art. The remote workstation 128 is typically a computing device such as a desktop PC, laptop, tablet, phablet or smart phone, to list a few examples.

Figure 2:
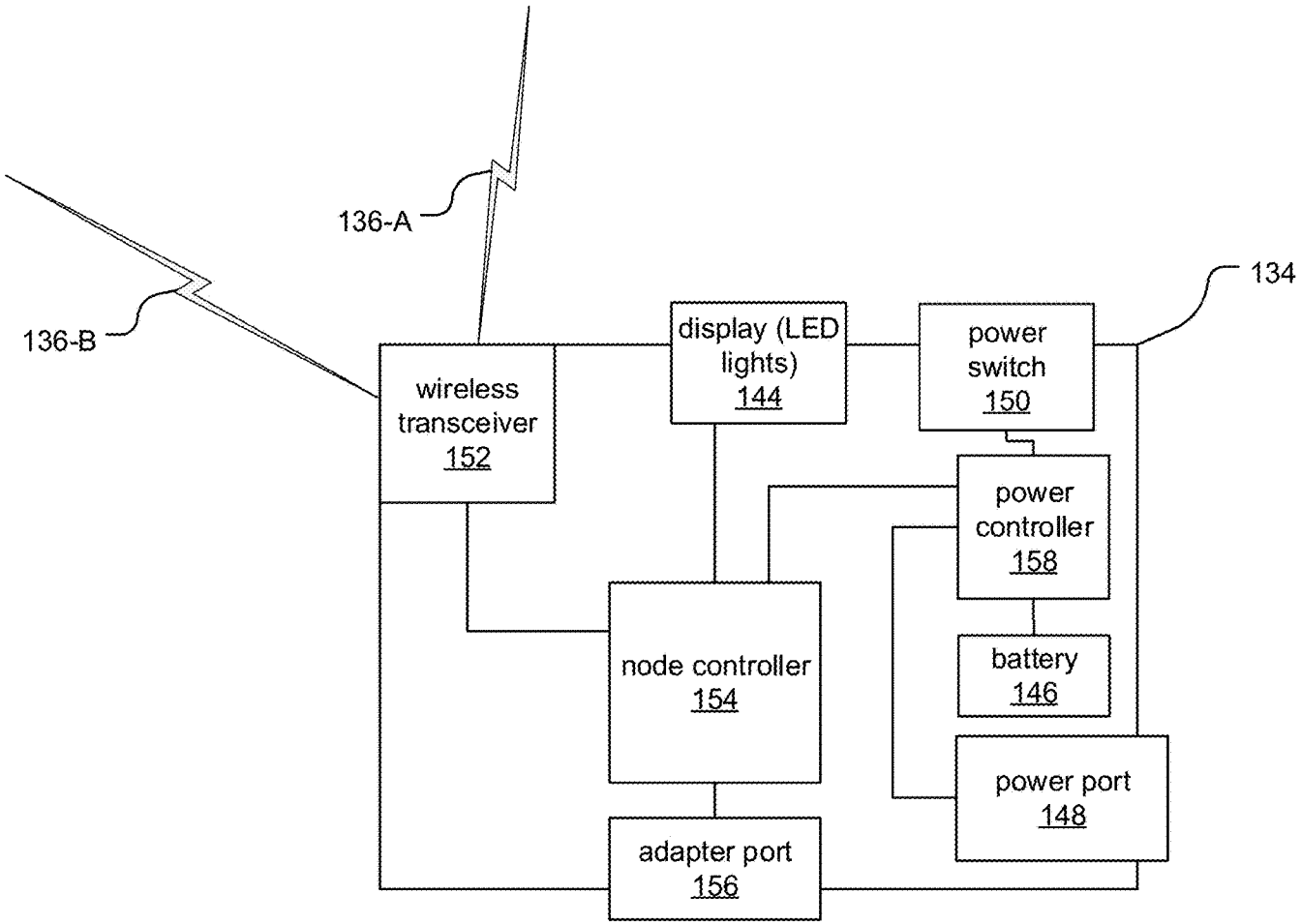
FIG. 2 is a block diagram of a mesh node used to establish a mesh network connection between the control panel and the facilities testing computer.

FIG. 2 is block diagram of an exemplary mesh node 134 of the mesh network 135.

The mesh node comprises a controller 154, such as a microcontroller. The node controller 154 primarily operates the wireless transceiver 152. It maintains the typically two wireless links 136-A, 136-B for example. It drives display LED lights 144 to provide the technician with status information.

The mesh node 134 further comprises an adapter port 156, If the mesh node 134 is being deployed as the primary mesh node, then the adapter port 156, which is usually a serial port and/or USB port is connected directly to the control panel 102.

Power for the mesh node 134 can come from different sources. The node 134 includes an integrated battery 146 in the preferred embodiment. The node 134 also comprises a power port 148 for receiving power from an external source such as parasitically from a device on the network 111, such as the strobe device 109-n as shown, The power controller 158 is operated by the power switch 150 and distributes power to the node controller 154, charges the battery 146 and powers the wireless transceiver 152.

Figure 3:
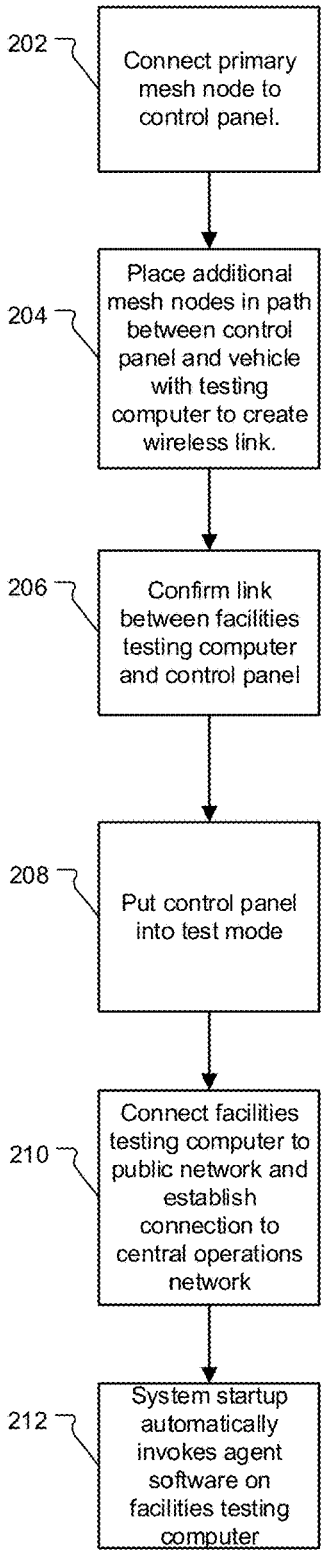
FIG. 3 is a flowchart illustrating the installation and setup of the facilities testing computer for the testing of a building's the fire alarm system.

FIG. 3 is a flowchart illustrating the installation and setup of the testing compute 104 and the connection with the fire control panel 102.

In the first step 202, the on-site technician 108 connects the primary mesh node 134-1 to the control panel 102, if required.

Next, in step 204, additional mesh nodes are distributed on the path between the control panel 102 and the vehicle 132 with the facilities testing computer 104.

In step 206, the mesh nodes 134 establish the mesh network connection between the control panel 102 and the transceiver 140 of the facilities testing computer 104.

In step 208, the on-site technician 108 puts the control panel 102 into test mode. This step ensures that the on-site technician 108 is at the building 50 and involved with the testing. Generally, this step is related to code compliance. It ensures the technician is on site and enables access to the auto acknowledgement features of the agent software and control panel (102) reset features of the mobile application.

Generally, test mode silences and/or deactivates audio and visual alarms/warnings of the fire annunciation devices during the walkthrough test. Generally, the fire detection devices are still able to detect indicators of fire, but audio and visual warnings of the fire annunciation devices are silenced if the fire detection device is activated. Additionally, if the fire detection devices have built in audio or visual alarms, these alarms are also typically silenced/deactivated in test mode. This allows the fire detection devices to continue detecting fires, but prevents the intentionally activated devices from disrupting occupants of the building or creating a false sense of concern during the walkthrough test.

Next, the on-site technician 108 connects the testing computer 104 to the public network 113 in step 210, typically via its cellular modem 142. In the next step 212, system startup of the testing computer 104 automatically invokes the agent software of the testing computer 104.

In an alternative implementation, the technician would install the primary node 134-1 in the control panel on the first visit and leave the node in the control panel 102. In such a configuration, the testing computer (104) could establish a wireless link to the panel on subsequent visits without requiring the technician to even open the panel. This embodiment could be beneficial, especially in the case where the cellular signal was adequate within the single hop connection range.

Figure 4:
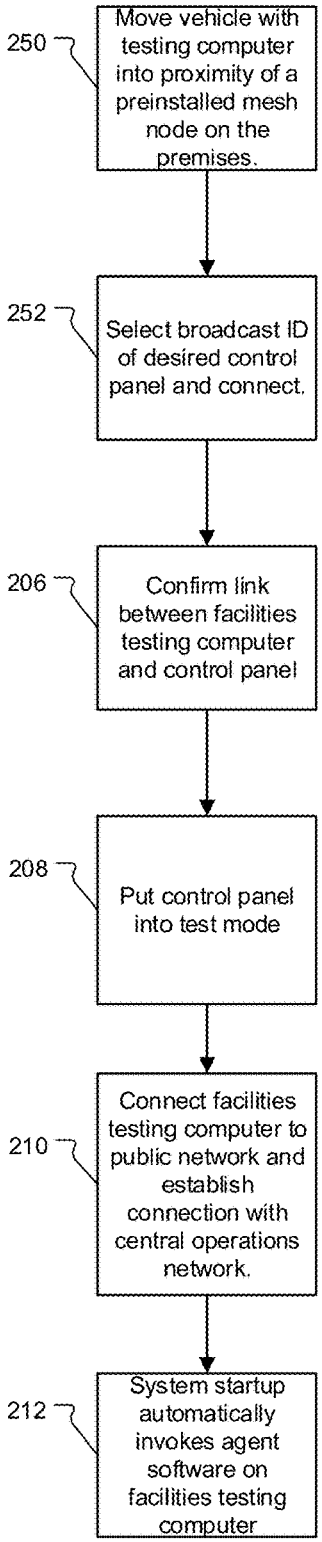
FIG. 4 is a flowchart illustrating the installation and setup of the facilities testing computer for the testing of a building's fire alarm system according to another embodiment.

FIG. 4 is a flowchart illustrating the installation and setup of the testing computer 104 and the connection with the fire control panel 102 when the mesh network 135 is permanently installed at the building 50.

In some cases, it may be desirable to permanently install the mesh network 135 at the building 50. In this example, the primary mesh node 134-1 will typically be integrated with the control panel 102 or be permanently connected to one of the panel's ports and powered from the control panel 102.

Additionally, any of the secondary mesh nodes 134 will typically be given more permanent installation locations. Often, the mesh nodes will be powered by a connection to one of the fire system's devices 109 or connected to the network 111. Their internal battery 146 will be used for only backup purposes, typically.

In this example, in step 250, when the technician's truck or vehicle 132 is moved near the building 50 it will come into range of the mesh network 135. Typically, it will select a broadcast ID generated by the mesh network 135, in step 252. Typically some form of authentication will be performed. Then, the remainder of steps 206, 208, 210, and 212 will be performed as described in connection with FIG. 3.

Figure 5:
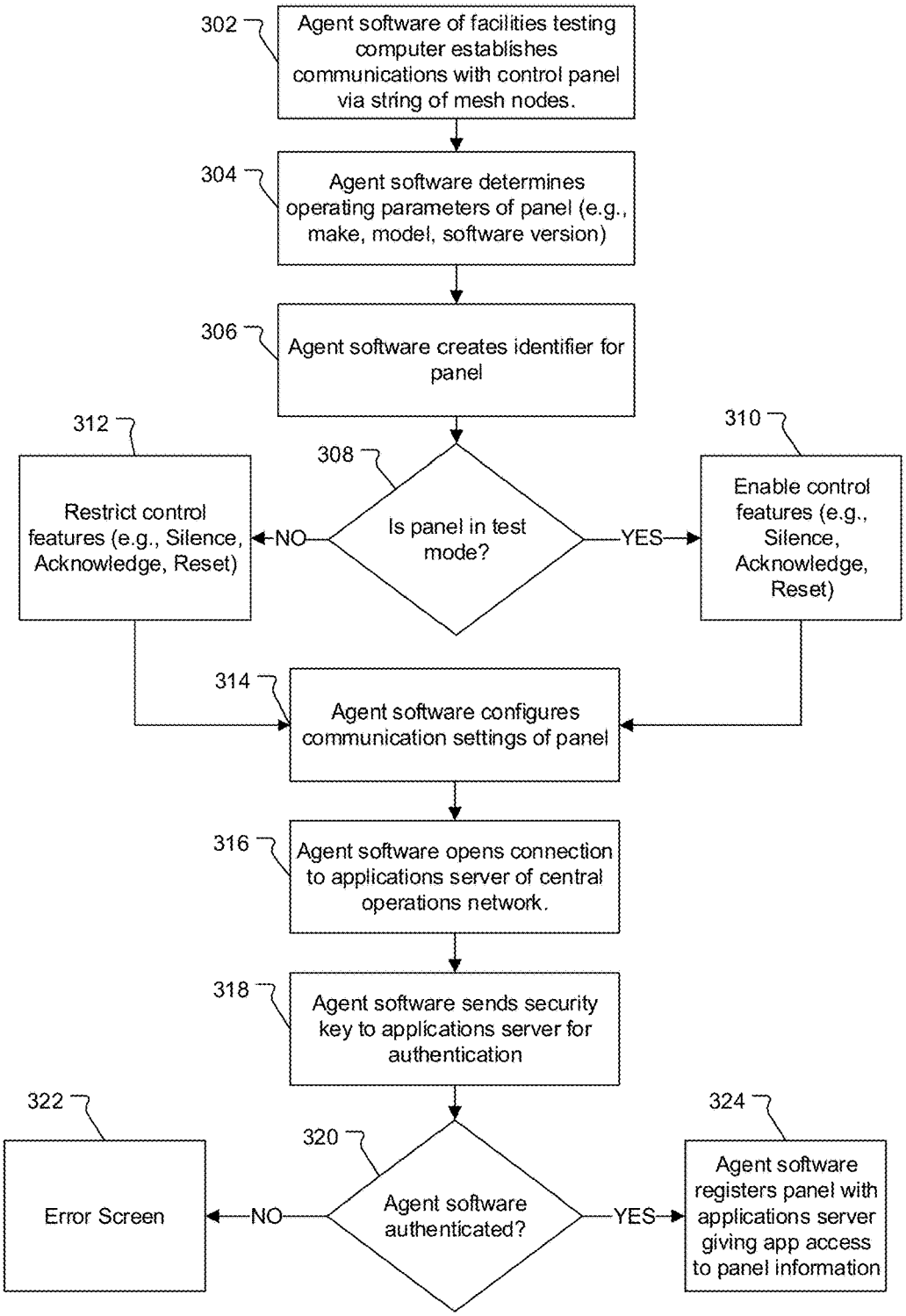
FIG. 5 is a flowchart illustrating the initialization of agent software of the facilities testing computer.

FIG. 5 is a flowchart illustrating the initialization of the agent software of the testing computer 104 as referenced in step 212 in FIGS. 3 and 4.

The agent software of the testing computer 104 establishes communication with the control panel 102 of the fire alarm system 100 in step 302 via the mesh network 135. Next, the agent software determines operating parameters (e.g., device name, model number, serial number, software revision, and configuration) of the control panel 102 in step 304. In the next step 306, the agent software creates or accesses a unique identifier for the control panel 102 over the mesh network 135.

The agent software then determines if the control panel 102 is in test mode in step 308. If the control panel 102 is in test mode, then control features (e.g., silence, acknowledge, and reset) are enabled in step 310. If the control panel 102 is not in test mode, then those control features are restricted in step 312.

The agent software then configures the communications settings of the control panel 102 in step 314. Next, in step 316, the agent software opens a connection to the applications server 122 through the firewall 120. The agent software sends a security key for authentication in step 318.

If the security key is authenticated in step 320, then the agent software registers the control panel 102 with the applications server 122 to enable an application (app) executing on the mobile computing device 110 to access information from the control panel in step 324. Alternatively, if the security key is not authenticated in step 320, then an error screen is displayed in step 322.

Figure 6:
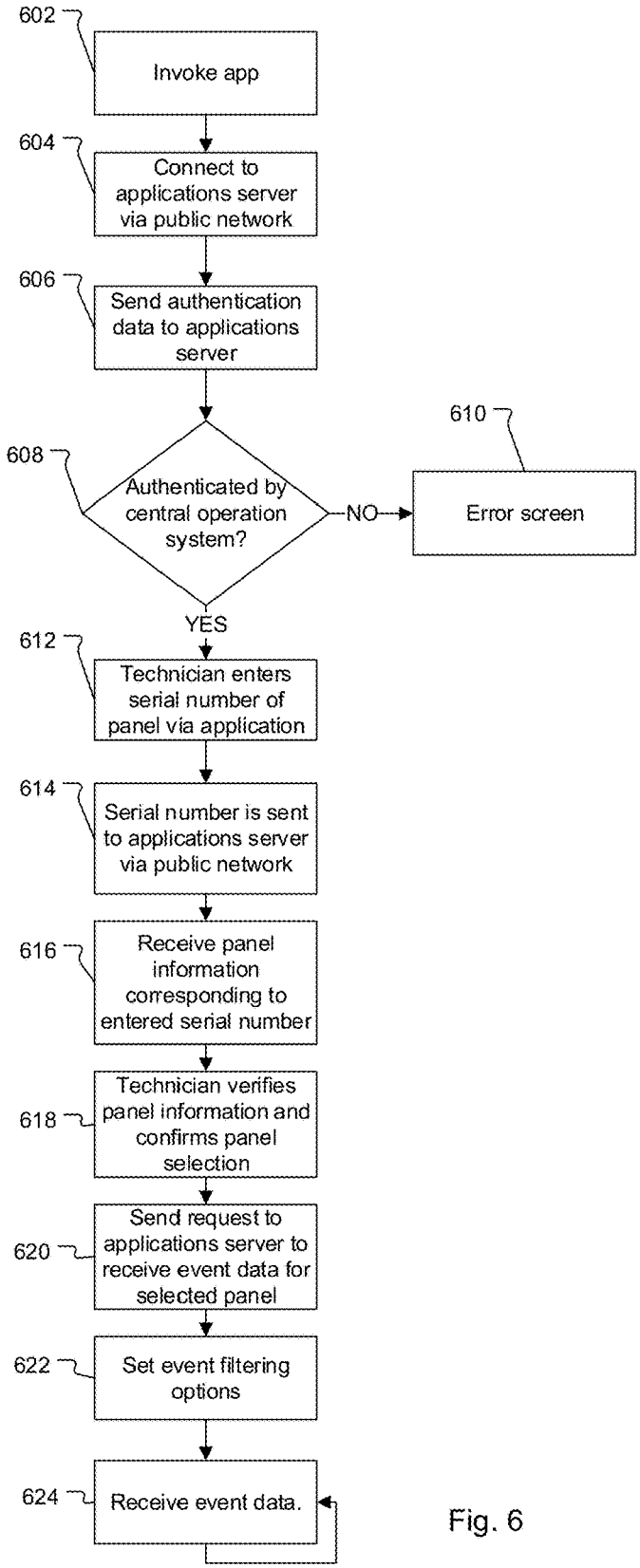
FIG. 6 is a flowchart showing an initialization of an application (app), which is invoked on a mobile computing device of a technician, to receive event data from the control panel.

FIG. 6 is a flowchart showing the initialization of the application (app), which is invoked by the on-site technician 108 operating the mobile computing device 110.

In a first step 602, the on-site technician 108 invokes the app on the mobile computing device 110. The app connects the mobile computing device 110 to the applications server 122 and sends authentication data to the applications server 122 in steps 604 and 606, respectively.

If the authentication data are not validated by the applications server 122 in step 608, then an error screen is displayed in step 610. If, however, the authentication data are validated by the applications server 122, then the on-site technician 108 enters all (or part) of a panel serial number via the app in step 612.

The serial number is sent to the applications server 122 of the central operation system 118 via the public network 113 in step 614, Next, in step 616, the mobile computing device 110 receives panel information (e.g., device name, device model, location, and customer ID associated with panel) that corresponds to the entered serial number, which information has been sent by the applications server 122. The on-site technician 108 verifies that the received panel information matches the control panel and confirms the control panel selection in step 618.

In the next step 620, the app sends a request to the applications server 122 of the central operation system 118 to receive event data for the selected control panel. The on-site technician is then able to set event filtering options in step 622 and receives the event data in step 624.

Figure 7:
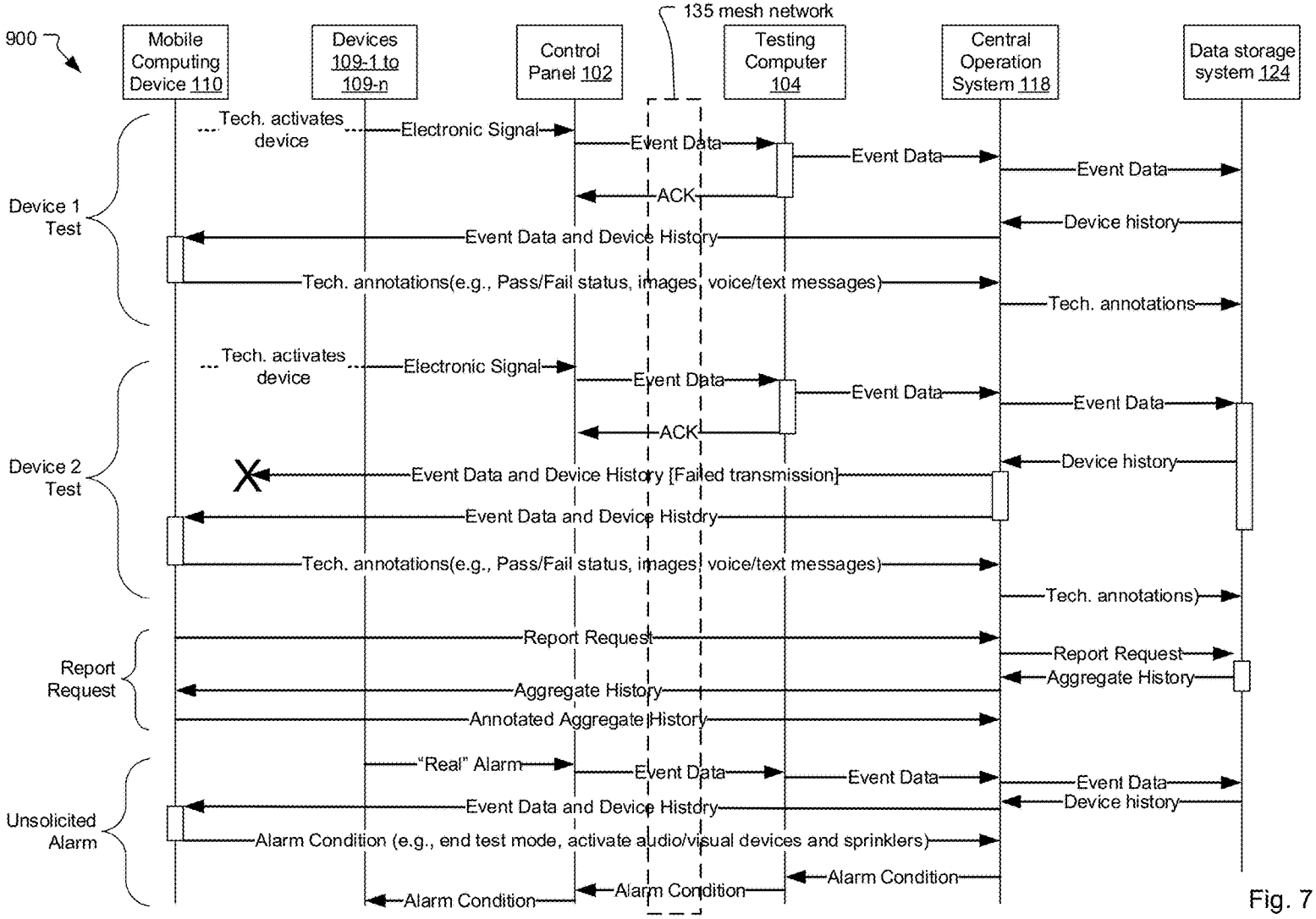
FIG. 7 is a sequence diagram illustrating how the mobile computing device, fire detection and fire annunciation devices, control panel, testing computer, central operations system, and data storage system interact during the test through the mesh network.

FIG. 7 is a sequence diagram 900 illustrating how the mobile computing device 110, fire detection and fire annunciation devices 109-1 to 109-n, control panel 102, testing computer 104, central operations system 118 (applications server 122), and data storage system 124 interact during the test. It shows the mesh network 135 supporting the duplex data connection between the control panel 102 and the testing computer 104.

In a first example (labeled Device 1 Test), the on-site technician 108 activates one of the fire detection and fire annunciation devices 109-1 to 109-n of the fire alarm system 100. The activated device sends an electronic signal to the control panel 102. The control panel generates event data, which are sent to the testing computer 104. If the control panel 102 is in test mode, that enables the Auto Acknowledgement feature in the agent software in the testing computer 104 so the testing computer 104 provides an immediate ACK to the control panel 102 to silence the local and remote sounders connected to the control panel 102. The event data are then sent from the testing computer 104 to the applications server 122 of the central operations system 118, which stores the event data in the data storage system 124. The central operations system 118 then sends the event data and device history data to the mobile computing device 110.

In the illustrated example, the on-site technician 108 reviews the event data and optionally applies annotations to the event data. These annotations typically include a pass or fail status, images, and/or voice and text messages, to list a few examples. For example, if the fire detection or fire annunciation device appears worn or damaged, the technician would annotate the event data with an image of the device. The annotated event data are then sent back to the central operations system 118 and stored in the data storage system 124. This annotated device history may be accessed later by the on-site technician 108, a remote technician 130, or other users that are authorized to access the event data.

A second example (labeled Device 2 Test) illustrates a scenario in which the mobile computing device 110 temporarily loses communication with the central operations system 118. In general, the testing process is similar to the previous example (i.e., Device Test 1). In this example, however, the mobile computing device 110 temporarily loses communication with the central operations system 118. Because communication has been lost, the transmission of event data from central operations system 118 fails to reach the mobile computing device 110. In the illustrated example, this is shown by the "X." In a current implementation, if there is a failed transmission, the central operations system 118 buffers and attempts to resend the event data. This event data could be resent based on a request from the mobile computing device 110 or the central operations system 118 could attempt to resend the event periodically until event data are received and acknowledged by the mobile computing device 110.

The sequence diagram 900 further illustrates a report request from the on-site technician (labeled Report Request). Typically, reports are generated after the on-site technician 108 has completed the test of the entire fire alarm system 100, but the on-site technician 108 (or a remote technician 130) could request a report at any time before or during the test.

In the illustrated embodiment, the on-site technician 108 sends a report request to the central operations system 118. The central operations system 118 queries the data storage system 124 to obtain an aggregate history for all of the fire detection and fire annunciation devices of the fire alarm system 100 that were activated/tested. The aggregate history data are transferred to the mobile computing device 110 and reviewed by the on-site technician 108. The on-site technician 108 may then add annotations to the aggregate history data and send the annotated aggregate history data to central operations system 118.

Additionally, the sequence diagram 900 also illustrates how the system handles an unsolicited or "real" alarm (labeled Unsolicited Alarm). While the illustrated embodiment distinguishes "real" alarms from technician activated alarms, these differences are only for illustrative purposes. In a typical implementation, the control panel 102 does not distinguish between "real" and technician activated alarms.

Upon receiving a "real" alarm signal, the control panel 102 generates event data, which is sent to the testing computer 104. The testing computer 104 sends the event data to the central operations system 118, which records the event data in the data storage system 124 and immediately sends the event data to the mobile computing device 110 of the on-site technician 108.

Upon receiving the event data for the unsolicited alarm, the on-site technician 108 is able to see and identify the unsolicited alarm. In the event that the unsolicited alarm represents a real emergency or threat to life and/or property, i.e., an actual fire, for example, the on-site technician generates an alarm condition command that is sent to the central operations system 118. The central operations system 118 sends an alarm condition command to the testing computer 104, which communicates the command to the control panel 102. The control panel 102 is then able to activate the audio and visual alarms/warnings of the fire annunciation devices to warn the building occupants of the possible emergency.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for testing a fire alarm system, the method comprising:

establishing a wireless connection via two or more wireless nodes deployed between a control panel of the fire alarm system and a testing computer;

providing each of the wireless nodes with a battery and/or a power port for providing power to the node, a wireless transceiver that transmits event data from the control panel to the testing computer over two wireless links, and a node controller for operating the wireless transceiver and maintaining the two wireless links; and a technician activating devices of the fire alarm system, event data being sent from the control panel to the testing computer via the one or more wireless nodes and over the wireless connection.

2. The method according to claim 1, further comprising sending the event data from the testing computer to a central operations system and from the central operations system to a mobile computing device operated by the technician.

3. The method according to claim 1, wherein establishing the wireless connection comprises connecting a primary mesh node to the control panel via a wired connection.

4. The method according to claim 3, wherein establishing the wireless connection comprises deploying one or more secondary mesh nodes in the building of the control panel, wherein the wireless connection extends from the primary mesh node through the one or more secondary mesh nodes to the testing computer.

5. The method according to claim 1, wherein establishing the wireless connection further comprises deploying secondary mesh nodes in connection with devices of the fire alarm system.

6. The method according to claim 3, wherein establishing the wireless connection comprises deploying two or more secondary mesh nodes in the building of the control panel, wherein the wireless connection extends from the primary mesh node and successively through two or more secondary mesh nodes to the testing computer.

7. A testing system for testing a fire alarm system, the system comprising:

a testing computer; and two or more wireless nodes establishing a wireless connection between a control panel of the fire alarm system and the testing computer, wherein the one or more wireless nodes are deployed between the control panel and the testing computer and event data is sent from the control panel to the testing computer using the wireless nodes;

wherein at least one of the nodes comprises: a battery and/or a power port for providing power to the node, a wireless transceiver that transmits event data from the control panel to the testing computer over two wireless links, and a node controller for operating the wireless transceiver and maintaining the two wireless links.

8. The system according to claim 7, further comprising: a central operations system and a mobile computing device operated by the technician, the event data being sent from the testing computer to the central operations system and from the central operations system to the mobile computing device.

9. The system according to claim 7, wherein the one or more wireless nodes includes a primary mesh node connected to a wired port of the control panel.

10. The system according to claim 9, wherein the one or more wireless nodes further includes one or more secondary mesh nodes deployed in the building of the control panel, wherein the wireless connection extends from the primary mesh node through the one or more secondary mesh nodes to the testing computer.

11. The system according to claim 7, wherein the one or more wireless nodes includes one or more secondary mesh nodes deployed in connection with devices of the fire alarm system.

12. The system according to claim 9, wherein the one or more wireless nodes further includes two or more secondary mesh nodes deployed in the building of the control panel, wherein the wireless connection extends from the primary mesh node successively through the two more secondary mesh nodes to the testing computer.

13. A wireless node for a testing system for a fire alarm system, the node comprising:

a wireless transceiver for establishing two or more wireless links to a testing computer;

a wired adapter port for connection to a control panel;

a battery and/or a power port for providing power to the node; and a node controller for operating the wireless transceiver and maintaining the two wireless links.

14. A node as claimed in claim 13, wherein the wireless transceiver transmits event data from the control panel to the testing computer over the wireless links.

15. A node as claimed in claim 13, further comprising a battery for powering the node.

16. A node as claimed in claim 13, further comprising a power port for receiving external power.

17. A node as claimed in claim 13, further comprising a power port for receiving external power from a fire alarm device.

18. A node as claimed in claim 13, wherein the wireless transceiver establishes wireless links with other wireless nodes.

19. A node as claimed in claim 13, wherein the wireless transceiver establishes wireless links with other wireless nodes to form a mesh network between the control panel and the testing computer.

* * * * *